United States Patent [19]

Fritz et al.

[11] Patent Number: 4,842,619

[45] Date of Patent: Jun. 27, 1989

[54] GLASS POLISHING ARTICLE

[75] Inventors: Peter J. Fritz, St. Louis Park; Joseph C. Nnebedum, Cottage Grove, both of Minn.

[73] Assignee: Minnesota Mining and Manufacturing Company, St. Paul, Minn.

[21] Appl. No.: 131,764

[22] Filed: Dec. 11, 1987

[51] Int. Cl.[4] ..... B24D 11/00

[52] U.S. Cl. ..... 51/295; 51/293; 51/298; 51/307

[58] Field of Search ..... 51/293, 307, 298, 295

[56] References Cited

U.S. PATENT DOCUMENTS

| | | | |
|---|---|---|---|
| 2,284,738 | 6/1942 | Hurst | 51/400 |
| 2,744,001 | 5/1956 | Harmann et al. | 51/308 |
| 2,865,725 | 12/1958 | Schroeder et al. | 51/295 |
| 2,958,593 | 11/1960 | Hoover et al. | 51/295 |
| 3,071,455 | 1/1963 | Harman et al. | 51/308 |
| 3,230,672 | 1/1966 | Anthon | 51/404 |
| 3,541,739 | 11/1970 | Bryon et al. | 51/295 |
| 3,597,887 | 8/1971 | Hall, Jr. | 51/295 |
| 3,959,935 | 6/1976 | Stoppacher | 51/395 |
| 4,138,228 | 2/1979 | Hartfelt | 51/295 |
| 4,227,350 | 10/1980 | Fitzer | 51/295 |
| 4,609,380 | 9/1986 | Barnett et al. | 51/298 |

*Primary Examiner*—Paul Lieberman
*Assistant Examiner*—Willie J. Thompson
*Attorney, Agent, or Firm*—Donald M. Sell; Walter N. Kirn; Richard Francis

[57] ABSTRACT

An abrasive article for polishing glass and ceramic surfaces comprised of a combination of abrasive particles and inorganic glass polishing aid dispersed throughout a three-dimensional nonwoven fibrous web of organic material, and adhered therein by a resinous binder. The article is capable of refining a ground glass or ceramic surface to a highly polished surface faster than abrasive articles known in the art.

15 Claims, 2 Drawing Sheets

GLASS POLISHING ARTICLE

TECHNICAL FIELD

The present invention relates to an abrasive article, which may be in the form of a wheel, for polishing glass or ceramic materials. More particularly, the invention relates to a three-dimensional nonwoven abrasive product which has been modified to polish glass and ceramics.

BACKGROUND ART

Nonwoven abrasive products are well known, for example, as disclosed in Hoover et al., U.S. Pat. No. 2,958,593. Such products are characterized by having abrasive particles dispersed throughout, and adhered in, a three-dimensional nonwoven fibrous web. Barnett et al., U.S. Pat. No. 4,609,380, discloses an abrasive wheel formed by adhering together layers of a nonwoven abrasive material of the type disclosed in Hoover et al., which is improved by the inclusion of a binder system comprising a blend of a tough adherent binder and a smear-reducing compatible polymer.

The refinement of glass and ceramic surfaces with abrasive materials is also well known. The abrasive material may be incorporated into an article, e.g., adhered to a backing or adhered within a three-dimensional matrix, or it may be fed as a slurry to the interface of a finishing tool and the workpiece.

Examples wherein the abrasive materials are adhered to a backing to form an abrasive article are disclosed in Schroeder, U.S. Pat. No. 2,865,725, Stoppacher, U.S. Pat. No. 3,959,935, and Anthon, U.S. Pat. No. 3,230,672. Schroeder adheres finely ground cerium oxide powder to a flexible sheet, preferably cotton fabric, to provide a polishing article. Stoppacher adheres an abrasive such as silicon carbide or garnet to a pliable sheet of paper, polymer, cloth, or nonwoven textile fabric to provide a lens grinding pad. Anthon discloses cushion mounting oriented particles of an abrasive material on a mesh fabric backing. The abrasive particles are predominantly oriented so as to present their plane faces or facets, and not their sharp edges or points, toward the work surface in a common plane parallel to the support. The oriented abrasive particles are adhered to the backing with an adhesive such as latex which is pliable, yieldable, or resilient when set. The cushion mounted abrasive particles can slightly rock or tilt, or recede, to accommodate themselves to the contour of the work surface thereby reducing surface abrasion and scratching.

Examples where the abrasive is adhered in a three-dimensional matrix are found in Hall, U.S. Pat. No. 3,597,887, and Hartfelt et al., U.S. Pat. No. 4,138,228. Hall discloses an abrasive wheel comprised of individual flexible elements secured together, wherein each element comprises an abrasive substance adhered in a matrix of synthetic resinous elastomeric foam permanently bonded in and to a fibrous mesh. Hartfelt et al. discloses adhering particles of abrasive, of average size less than 10 microns, from the rare earth oxide or metal oxide classes of compounds in a microporous polymer matrix coated on a backing. The microporous polymer must be a hydrophilic water-absorbing polymer, or a polymer which forms only a weak bond with the abrasive particles, so that a controlled release of the abrasive particles from the matrix is obtained during use.

The use of abrasive material in a slurry to polish glass is also well known in the art. Such abrasive materials include silicon carbide, vitreous silica, garnet, metal oxides, rare earth oxides, and mixtures of known abrasives with rare earth oxides. Harman et al., U.S. Pat. No. 2,744,001, for example, disclose the addition of rare earth oxides to vitreous silica, each having a particle size of 20 microns or less, to produce a slurry-type polishing mixture that is superior to either of the component materials used alone.

While a considerable need exists to provide a finishing article for use on glass and ceramics which rapidly achieves a desired polished surface, comparable to the result achieved with slurry polishing, as far as is known no such article exists.

DISCLOSURE OF THE INVENTION

The present invention provides an abrasive article capable of attaining highly polished glass and ceramic surfaces while exhibiting polishing speeds and efficiencies previously unattainable without the use of polishing slurries.

The present invention provides an abrasive article, preferably in the form of a wheel, comprising a three-dimensional nonwoven fibrous web having dispersed throughout and adhered therein by a binder, a mixture of glass polishing abrasive and inorganic glass polishing aid. The glass polishing abrasives are the type commonly used for polishing glass, with those having a Moh's hardness greater than 5 being preferred. Useful examples of such abrasives include silicon carbide, aluminum oxide, fused aluminum oxide, and garnet, with garnet being preferred. The inorganic glass polishing aid used in the present invention includes certain materials which are known in the art to be used in slurry form for this purpose and a certain other material for which this use is not conventional. The preferred known glass polishing aids are the rare earth oxides and the preferred new glass polishing aid is potassium fluoborate.

The incorporation of the polishing aid into an abrasive article, according to the present invention, endows the abrasive article with an unexpected increased polishing efficiency which was heretofore unrecognized for abrasive articles. It provides polishing efficiencies previously attainable only by use of polishing slurries, but without the inherent drawbacks of slurries. Slurries are messy and inconvenient to use, requiring frequent replenishing and backup lap replacement, which tend to inhibit high production rate processes.

The incorporation of one or more of the named polishing aids, and one or more of the named abrasives, into the abrasive article of the present invention produces an abrasive article capable of refining a ground glass surface to a highly polished glass surface faster than other abrasive articles known in the art. This increased polishing speed is believed to result from the unique combination of the superior cutting ability of the hard abrasive particles which quickly level the surface; the spring-like action of the three-dimensional nonwoven web which allows the hard abrasive particles to glide over the leveled surface, as if attached to individual springs, without deeply abrading it; and the polishing aid which polishes the leveled surface. The abrasive article of the present invention accomplishes in one step that which previously required sequential refining operations using a variety of abrasive materials.

DETAILED DESCRIPTION

Figure 1:
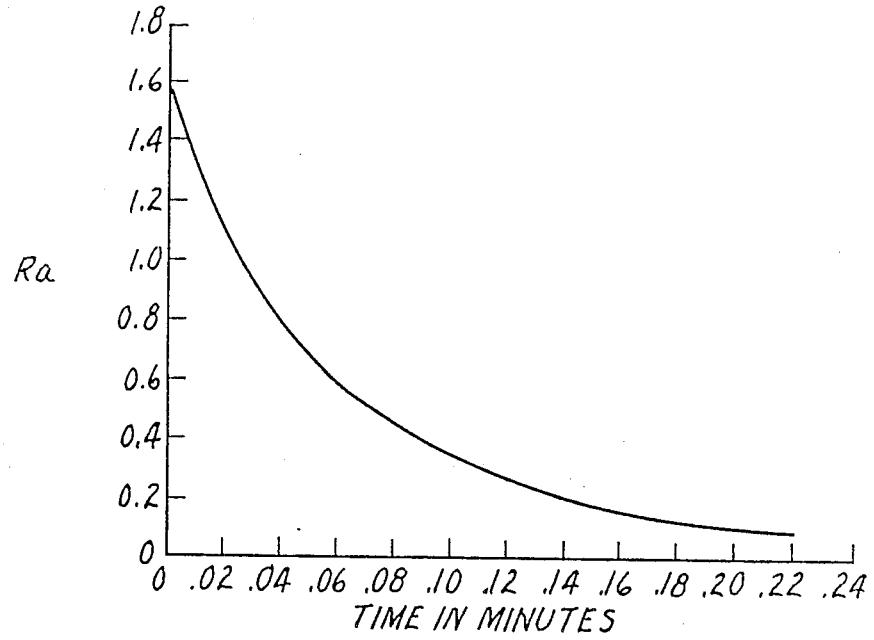

The abrasive products of the present invention may take any of a variety of conventional forms. The preferred products of the present invention are in the form of wheels. Such wheels are typically in the form of a disc or right cylinder having dimensions which may be very small, e.g., a cylinder height on the order of one centimeter, or very large, e.g., two meters or more, and a diameter which may be very small, e.g., on the order of a few centimeters, or very large, e.g., one meter or more. The wheels typically have a central opening for support by an appropriate arbor or other mechanical holding means to enable the wheel to be rotated in use. Wheel dimensions, configurations, means of support, and means of rotation are all well known in the prior art.

The abrasive products of the present invention may be prepared by appropriate techniques which are also well known in the prior art. Coated nonwoven webs containing abrasive particles, glass polishing aids, binder resin, and any supplemental material are most useful when formed into a wheel structure. Conventional methods and materials are used to produce such wheels. Typically, these coated webs are coated with a liquid adhesive composition (hereinafter referred to as the "size" coat) via a two-roll coater. The webs are then either layered on one another, compressed and cured with heat under compression to produce a slab of abrasive product with the desired density from which a wheel may be cut; or spirally wound under sufficient tension or compaction force to produce an abrasive wheel with the desired density, and then heated to cure the liquid adhesive. The desired density of the abrasive wheel is typically from 200 $kg/m^3$ to 850 $kg/m^3$ with the preferred density range being from 350 $kg/m^3$ to 650 $kg/m^3$. It is important that sufficient adhesive be used to secure the layers together, but not so much as to cause masking of the abrasive material and polishing aid containing coating, as such masking may unacceptably reduce the abrasion and polishing performance of the wheel. A preferred amount of added adhesive is about 10 to 40%, with the most preferred being about 15 to 20% of the total weight of the abrasive material and polishing aid coated web. Suitable adhesives are well known in the art.

The nonwoven fibrous backing web, used to make the abrasive wheels of the present invention, may be prepared by techniques which are also well known in the prior art. The web can be formed of continuous three-dimensionally undulated inter-engaged autogenously bonded filaments of high yield strength filament-forming material as described in Fitzer, U.S. Pat. No. 4,227,350, which is incorporated herein by reference. The preferred nonwoven backing web is, however, made from crimped, oriented staple synthetic fibers as described in Hoover et al., U.S. Pat. No. 2,958,593, which is incorporated herein by reference. These fibers are typically 6 to 200 denier per filament and preferably 6 to 100 denier per filament. These preferred webs can be laid by either air or mechanical means. Suitable equipment for making air laid nonwoven web is made by Dr. O. Angleitner (DOA), Procter & Schurz, and Rando Machine Corporation. Suitable equipment for making mechanical laid nonwoven web is made by Hergeth KG, and Hunter.

After being formed, the fibers of the nonwoven web should be bonded at points of contact (prebonded) to provide the web with sufficient integrity to withstand the subsequent coating process without being appreciably distorted. Bonding agents suitable for prebonding include melt bondable fibers, liquid and solid adhesives, and the like, which provide an adherable surface for subsequent coatings. In prebonding, the minimum amount of such coating necessary to stabilize the nonwoven web backing is preferred. When the binder coating containing the abrasive particles and polishing aids (hereinafter referred to as the "make" coat) is to be applied by a roll coater, it is important that the nonwoven web be prebonded. However, if the make coat is to be applied by spray coating, prebonding is preferred but not required. The prebonded nonwoven webs should have appropriate openness and thickness to permit subsequent coatings to uniformly permeate the entire web structure. Typically, the nonwoven web backings are 5 to 20 mm thick.

The make coat used in the present invention contains a binder resin, particles of abrasive material, selected inorganic glass polishing aids, optional fillers, coating aids such as viscosity control agents, anti-foam material, and solvents. The binder resin, when cured, forms a strong adherent bond between the fibers of the unbonded or prebonded nonwoven web and the abrasive particles and polishing aids, to maintain the structural integrity of the article under conditions existing during use. The binder has a liquid state and is rendered solid under suitable process conditions. Examples of suitable binder resins are curable phenol-formaldehyde resins, melamine-formaldehyde resins, epoxy resins, polyurethane resins, and the like.

Abrasive materials used in the wheels of the present invention are selected from those abrasive materials commonly used for abrasion of glass. Such abrasive materials preferably have Moh's hardness of 5 or greater. Examples of preferred abrasive materials include garnet, silicon carbide, aluminum oxide and fused aluminum oxide. The weight ratio of abrasive material to binder resin is similar to that known in the conventional production of nonwoven abrasive articles, typically from about 1:1 to about 3.5:1, and preferably about 2:1. The size of the abrasive particle is determined both by its ability to impregnate the nonwoven backing and by the desired glass or ceramic surface finish. Larger abrasive particles have a greater difficulty impregnating less open nonwoven webs, and may produce a polished glass finish having unwanted roughness or scratches. Typically the average particle size of the abrasive ranges from about 50 micrometers (280 grade) to about 175 micrometers (80 grade) with the preferred range being from about 85 micrometers (180 grade) to about 125 micrometers (120 grade) with 105 micrometers (150 grade) being most preferred.

The inorganic glass polishing aids suitable for use in the present invention are preferably selected from the group consisting of potassium fluoborate, and the rare earth oxides. By "rare earth oxides" we mean mixtures of the oxides of the fifteen rare earth elements having atomic numbers 57–71 inclusive. It is believed that all of these metal oxides will individually function as glass polishing aids according to the present invention. However, due to the difficulty involved in separating out any one of these metal oxides in pure form, only mixtures of these metal oxides are commercially feasible at this time. These mixtures are commercially available, for example from Cercoa Incorporated under the trade designation SUPEROX 50, and typically are predominantly cerium oxide. An effective amount of the glass polishing aid, as herein used, is a range which, as a minimum, is an amount required to effect a polished glass surface, and, as a maximum, is an amount that is just less than that which will diminish the durability and strength of the binder resin. In numerical terms, the amount by weight of polishing aid should preferably be more than about one part per 40 parts binder but no more than one part polishing aid per 4 parts binder. Most preferably the weight ratio of polishing aid to binder resin is from about 1:25 to about 1:8.

Although it is preferred that the abrasive materials and the polishing aids be incorporated into the make coat, they may be incorporated into the size coat of adhesive when the abrasive product is to be in the form of a wheel.

Any combination of the named glass polishing aids and abrasive materials, incorporated into the abrasive article of the present invention, will exhibit enhanced polishing efficiencies. A preferred combination, according to the present invention, is obtained when the abrasive material is garnet, most preferably having an average particle size of about 105 micrometers (150 grade), the polishing aid is a mixture of potassium fluoborate and rare earth oxides, and the make coating contains cryolite filler, most particularly with both polishing aid and the abrasive particles also being contained in the make coating.

The invention is further illustrated by the following non-limiting examples, wherein all parts are by weight unless otherwise specified.

EXAMPLES

EXAMPLE 1

A 15 mm thick low density non-woven web weighing 113 g/m$^2$ was formed from crimped 13 denier, 40 mm long, nylon 6–6 fibers on a commercially available web forming machine. The resulting low density unbonded nonwoven web was coated, using a bottom feed 2-roll coater, with a prebond resin and cured to produce a bonded nonwoven web 12 mm thick and having a total weight of 160 g/m$^2$. The prebond coating consisted of 30% 2-propanol, 30% propylene glycol monomethyl ether (PGME), 5% polyvinyl butyral resin (commercially available from Monsanto Company under the trade designation Butvar B-98), 35% of a based catalyzed resole phenol-formaldehyde resin having 70% non-volatiles, and a trace of a silicon emulsion (commercially available from Dow Corning under the trade designation 1520 Silicone Antifoam). The coated nonwoven web was cured to a nontacky state by heating for 3 minutes in a hot air oven maintained at 150° C.

A make coat mixture consisting of 11.9% propylene glycol monomethyl ether (PGME), 8.5% diethylene glycol ethyl ether (commercially available from Union Carbide Corporation under the trade designation Carbitol), 32.0% base catalyzed resole phenol-formaldehyde resin containing 70% non-volatiles, 0.6% of a 50% aqueous sodium hydroxide solution, a trace of a silicon emulsion (commercially available from Dow Corning under the trade designation 1520 Silicone Antifoam), 0.9% fumed silica (commercially available from Cabot Corporation under the trade designation Cab-O-Sil M5), 1.2% calcium carbonate, 1.5% potassium fluoborate, and 43.4% garnet abrasive particles having average particle size of about 105 micrometers (150 grade) was roll coated into the prebonded nonwoven web. The coated web was then heated in a hot air oven at 150° C. for about 4 minutes. The coated and cured web weighed 1260 g/m$^2$ and was about 10 mm thick.

The abrasive and polishing aid coated nonwoven web was then roll coated, using a 2-roll coater, with a wheel unifying adhesive mixture size coat containing 49.8% xylol, 6.1% methylene dianiline (MDA), 11.3% 2-methoxypropanol acetate, and 32.8% ketoxime-blocked poly 1,4 butylene glycol diisocyanate having a molecular weight of about 1500 (commercially available from Uniroyal Chemical Company under the trade designation Adiprene BL-16). The coating was applied at a rate calculated to produce a 20% dry add-on based on the weight of the abrasive and polishing aid coated web. The coated web was passed through a 70° C. hot air oven with a residence time of about 4 minutes which partially dried the coating. The partially dried web was then spirally wound, with some compaction force, onto a 125 mm diameter core until an outside diameter of 320 mm was achieved. The spirally wound bun was heated to cure the coating by forcing 90° C. heated air through an end of the spirally wound bun for 1 hour and then cured further with 120° C. forced air for 2 hours after the exit air from the outer edge of the spirally wound bun reached 120° C. Layers of the bun were adhered together and the resultant bun had a density of 520 kg/m$^3$. The resultant bun was cut transversely to produce wheels 50 mm wide having a 125 mm inside diameter and 320 mm outside diameter.

EXAMPLE 2, AND CONTROL EXAMPLE A

Example 2, and Control A, were prepared using the same method, same prebonded nonwoven web, same make coat dry add-on coating weight, and same wheel unifying adhesive size coat, as described in Example 1. Only the make coat containing the abrasive particles and polishing aids was changed. Table I provides the composition of these make coats, and for ready comparison the make coat composition used in Example 1. Wheels, 50 mm wide, were also cut transversely from buns made in these examples.

TABLE I

| | Make Coat Compositions | | |
|---|---|---|---|
| Examples | 1 | 2 | A |
| PGME | 11.9 | 15.0 | 14.6 |
| Carbitol | 8.5 | 8.3 | 8.1 |
| Phenol-formaldehyde resin | 32.0 | 31.3 | 27.3 |
| 50% NaOH | 0.6 | 0.6 | 0.6 |
| Garnet, 150 grade | 43.4 | 42.4 | 47.7 |
| Cab-O-Sil M-5 | 0.9 | 0.7 | 0.8 |
| Calcium carbonate | 1.2 | 0.9 | 0.9 |
| Potassium fluoborate | 1.5 | 0.0 | 0.0 |
| Rare earth oxide (cerium oxide) | 0.0 | 0.9 | 0.0 |
| 1520 Sil. Antifoam | Trace | Trace | Trace |

The wheels produced in the above examples were evaluated for ability to refine a controlled surface of a glass test specimen as a function of time. This test procedure was used to determine if these wheels might be suitable in commercial applications. A modified Model MB-16 Professional Glass Beveler manufactured by Denver Glass Machinery was used. This dual vertical spindle machine was modified by addition of a traversing mechanism and sample holder which permitted a test glass specimen to be urged against abrasive media on each of the side-by-side spindles. A mechanism was attached to the traversing mechanism to apply a controlled force to the test specimen. An electronic control mechanism was used to control the time that the test specimen engaged each abrasive media.

The abrasive media used to produce the controlled glass surface was a 400 mm diameter cast iron lapping wheel, mounted on one of the vertical spindles which rotated at 1200 RPM, with a 2% aqueous slurry of garnet abrasive particles having an average particle size of about 40 micrometers (350 grade). The test specimen, while in contact with the iron lapping wheel, was traversed in an oscillatory pattern over an annulus having an inside diameter of 190 mm and an outside diameter of 370 mm.

A 320 mm outside diameter nonwoven abrasive test wheel, formed as described in the preceding examples, was mounted on the other vertical spindle so that the major surface (side surface) of the test wheel contacts the surface of the test specimen. As the test wheel was rotated at 1200 RPM, the test glass specimen was urged against the test wheel in an oscillatory pattern over an annulus having an inside diameter of 130 mm and an outside diameter of 280 mm.

The test glass specimen was a leaded glass used in cathode ray tubes, having dimensions of 50 mm long, 9 mm wide and 25 mm deep. The 9 mm by 50 mm facet was urged against the abrasive media. The test specimen was first urged for about 5 seconds at a constant force of $3.4\times10^3$ Pa against the cast iron lapping wheel while a flood of the slurry was pumped onto the iron lap wheel surface. After measurement of the surface roughness the test glass specimen was then urged, at a constant force of $41.4\times10^3$ Pa, against the test wheel for about 3 seconds while 35° C. water flooded the wheel surface. The cycle of conditioning the test specimen and polishing on the test wheel was repeated five times, during which the contact times for conditioning and polishing were held constant by the electronic control mechanism. At the end of five cycles the surface roughness of the test specimen was remeasured, and recorded along with the corresponding polishing time per cycle. This procedure was repeated for additional polishing time intervals ranging from about three seconds to about fifteen seconds, with five cycles being performed at each polishing time before the surface roughness was measured and recorded.

The surface roughness of the test glass specimens was measured using a Perthometer Model S6P fitted with a Perthen Model RHT 650 stylus. The arithmetic mean average surface roughness of each test glass specimen was measured ten times and the average reported in micrometer units ($R_a$). $R_a$ is an average of the peak-to-valley heights over the surface. This measurement, taken after increasing time that the test specimen was in contact with the test wheel, indicates how quickly a given wheel refines a controlled ground glass surface.

Figure 2:
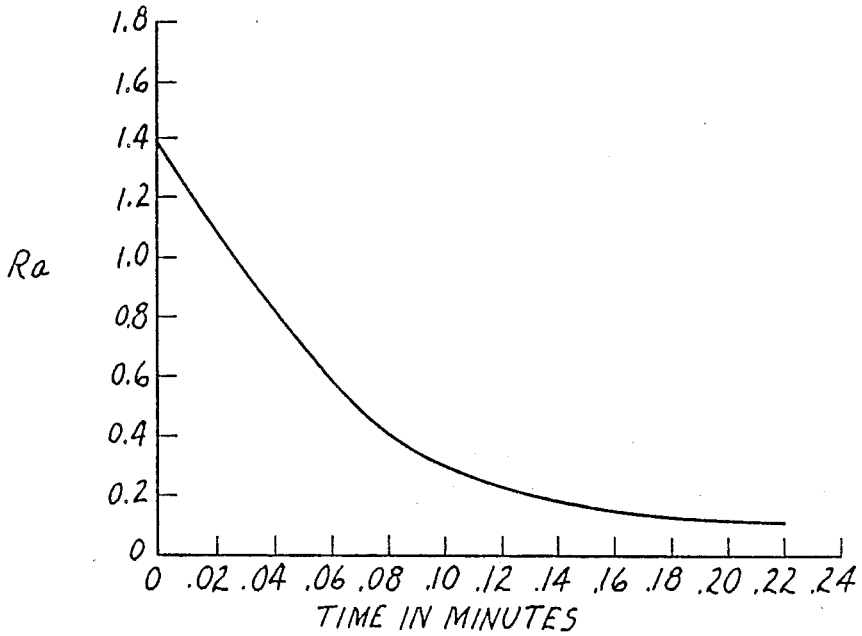
Figure 3:
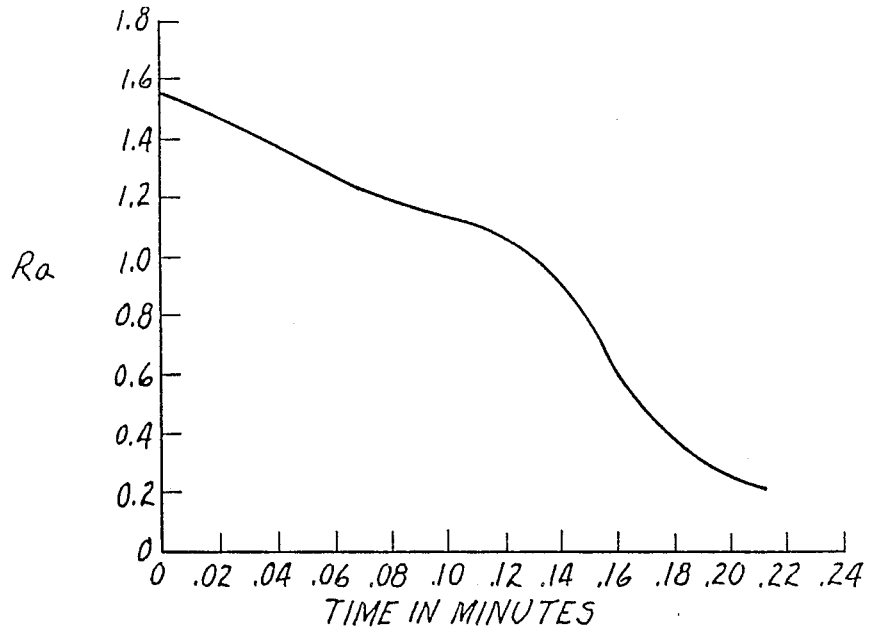

The data collected during these tests are presented in graphs generated by plotting $R_a$ versus time for each of the test wheels evaluated (FIGS. 1–3). These graphs show the change in the surface roughness of the test glass specimen ($R_a$) as a function of polishing time on the test wheel. FIGS. 1, 2, and 3 represent the data collected in testing the polishing wheels of Examples 1, 2, and Control A respectively.

These graphs exhibit two characteristics of the polishing articles of the present invention. First, these graphs show that all of the test wheels, including the wheel produced in Control Example A containing only garnet abrasive particles having an average particle size of about 105 micrometers (150 grade), were able to polish a glass surface roughened with a slurry of garnet particles having an average particle size of about 40 micrometers (350 grade). Second, the graphs show that the wheels containing potassium fluoborate or rare earth oxide polishing aid in addition to garnet abrasive particles (FIGS. 1 and 2) polished the ground glass surface much more quickly than the wheel containing only garnet abrasive particles (FIG. 3). Since the commercial utility of glass polishing abrasive articles in high production rate processes depends upon the speed with which the abrasive article can produce a highly polished surface, the increased polishing speed of the abrasive articles of the present invention gives them greater utility than other abrasive articles known in the art.

While the invention has been particularly described with reference to certain specific embodiments thereof, it is to be understood that such embodiments are intended to illustrate rather than to limit the invention and that changes may be made therein without departing from the scope of the invention as defined in the appended claims. Additionally, although the description of the invention deals only with its use for refining glass and ceramic surfaces, the article may have utility in refining other surfaces such as metal.

We claim:

1. An article especially suited for polishing glass or ceramic surfaces, said article comprising:

(a) a three-dimensional nonwoven web of organic fibers, (b) a quantity of particles of abrasive material suited for polishing said surfaces dispersed throughout said web and adhered to said fibers, (c) a quantity of inorganic glass polishing aid dispersed throughout said web and adhered to said fibers, and (d) a binder adhering said fibers together at contacting points and said particles of abrasive material and said inorganic polishing aids to said fibers;

wherein the quantity of particles of abrasive material and the quantity of inorganic glass polishing aid are each selected to provide said article with the ability to polish said surface more quickly than the same article having only said abrasive particles or said inorganic glass polishing aid.

2. The article of claim 1 wherein said article is in the form of a wheel having a density from about 200 kg/m$^3$ to about 850 kg/m$^3$.

3. The article of claim 2 wherein said article has a density from about 350 kg/m$^3$ to about 650 kg/m$^3$.

4. The article of claim 3 comprising a laminate of two or more discs of said web.

5. The article of claim 3 comprising a spirally wound and adhered strip of said web.

6. The article of claim 1 wherein said nonwoven fibrous web comprises crimped, oriented staple synthetic fibers of about 6 to about 200 denier per filament.

7. The article of claim 6 wherein said fibers are from about 6 to about 100 denier per filament.

8. The article of claim 1 wherein said nonwoven fibrous web comprises a multitude of continuous three-dimensionally undulated filaments of high yield strength filament-forming organic thermoplastic material having a diameter of about 0.1 mm to about 3 mm with adjacent filaments being inter-engaged and autogenously bonded where they touch one another.

9. The article of claim 1 wherein said abrasive material is selected from the group consisting of garnet, silicon carbide, aluminum oxide, fused aluminum oxide, and mixtures of two or more of these.

10. The article of claim 1 wherein said inorganic polishing aid is selected from the group consisting of potassium fluoborate, rare earth oxides, and mixtures thereof.

11. The article of claim 1 wherein said binder is selected from the group consisting of phenolformaldehyde resins, melamine-formaldehyde resins, epoxy resins, and polyurethane resins.

12. The article of claim 1 wherein the weight ratio of abrasive material to binder resin is from about 1:1 to about 3.5:1.

13. The article of claim 1 wherein the weight ratio of inorganic polishing aid to binder resin is from about 1:40 to about 1:4.

14. The article of claim 13 wherein the weight ratio of inorganic polishing aid to binder resin is from about 1:25 to about 1:8.

15. An abrasive wheel for refining glass or ceramic surfaces, said abrasive wheel having a density from about 350 kg/m$^3$ to about 650 kg/m$^3$ and comprising:

(a) a prebonded three-dimensional nonwoven web of crimped, oriented staple synthetic fibers of about 6 to about 100 denier per filament, (b) a quantity of garnet abrasive particles having an average particle size of about 105 micrometers dispersed throughout said web and adhered to said fibers, (c) a quantity of glass polishing aid consisting of a mixture of potassium fluoborate and rare earth oxides dispersed throughout said web and adhered to siad fibers, and (d) phenol-formaldehyde binder resin adhering said garnet, potassium fluoborate and rare earth oxides to said fibers;

wherein the quantity of particles of garnet abrasive and the quantity and composition of the polishing aid mixture is each selected to maximize the polishing speed of said article.

* * * * *

UNITED STATES PATENT AND TRADEMARK OFFICE

CERTIFICATE OF CORRECTION

PATENT NO. : 4,842,619

DATED : June 27, 1989

INVENTOR(S) : Peter J. Fritz and Joseph C. Nnebedum

It is certified that error appears in the above-identified patent and that said Letters Patent is hereby corrected as shown below:

Col. 8, line 39, insert the word --glass-- after "inorganic".

Col. 8, line 39, "aids" should read --aid--.

Col. 9, line 4, insert the word --glass-- before "polishing".

Col. 9, line 17, insert the word --glass-- after "inorganic".

Col. 10, line 14, "siad" should read --said--.

Signed and Sealed this

Thirty-first Day of August, 1993

Bruce Lehman

*Attest:*

BRUCE LEHMAN

*Attesting Officer*

*Commissioner of Patents and Trademarks*